United States Patent [19]

Adebahr

[11] Patent Number: 4,548,215

[45] Date of Patent: Oct. 22, 1985

[54] METHOD AND MACHINE FOR MAKING CONTINUOUS CIGARETTE RODS AND THE LIKE

[75] Inventor: Klaus Adebahr, Hamburg, Fed. Rep. of Germany

[73] Assignee: Hauni-Werke Körber & Co. KG., Hamburg, Fed. Rep. of Germany

[21] Appl. No.: 528,961

[22] Filed: Sep. 2, 1983

[30] Foreign Application Priority Data

Sep. 3, 1982 [DE] Fed. Rep. of Germany ..... 3232777

[51] Int. Cl.[4] ..... A24C 5/18

[52] U.S. Cl. ..... 131/84.4; 131/906; 131/84.1

[58] Field of Search ..... 131/84 C, 84 A, 84 R, 131/906

[56] References Cited

U.S. PATENT DOCUMENTS 3,170,467 2/1965 Giagomo ..... 131/84 A 3,261,365 7/1966 Korber ..... 131/84 C

*Primary Examiner*—V. Millin

*Attorney, Agent, or Firm*—Peter K. Kontler

[57] ABSTRACT

The distance between the equalizing device and the conveyor which transports a tobacco stream past the equalizing device in a cigarette rod making machine is adjustable in order to change the density of the filler into which the stream is converted as a result of removal of excess tobacco therefrom. The firmness of the filler, which is thereupon confined in a web of cigarette paper, is regulated by changing the ratio of the speed of the conveyor which transports the tobacco stream past the equalizing device to the speed of the conveyor which transports the filler through the draping mechanism. The speed of one of the conveyors is changed in response to signals which are generated by a device for monitoring the firmness of the confined filler, either directly by monitoring the firmness of the filler downstream of the draping mechanism or indirectly by monitoring the quantity of tobacco per unit length of the unconfined filler between the equalizing device and the draping mechanism.

25 Claims, 6 Drawing Figures

METHOD AND MACHINE FOR MAKING CONTINUOUS CIGARETTE RODS AND THE LIKE

BACKGROUND OF THE INVENTION

The present invention relates to a method and to a machine for making a continuous rod of the type wherein a web of wrapping material (e.g., cigarette paper) confines a rod-like filler of smokable material, particularly tobacco. A typical example of such product is a continuous cigarette rod which is produced in a cigarette rod making machine and is subdivided into sections (plain cigarettes) of unit length or multiple unit length.

A cigarette rod is obtained by converting a shower of tobacco particles (and/or particles consisting of other fibrous smokable material) into a stream containing tobacco in excess of that which is required in the rod, by trimming or equalizing the stream including removing the excess of fibrous material, and by thereupon draping the resulting rod-like filler into a web of cigarette paper or other suitable wrapping material. The draping normally takes place simultaneously with radial compacting of tobacco during transport through the compacting mechanism (garniture) which converts a flat web or strip of wrapping material into a tubular envelope surrounding the filler and having a seam extending in parallelism with the axis of the rod. It is also known to regulate the rate of removal tobacco by the equalizing device in response to signals which are furnished by a density monitoring device and denote the density of the filler, normally of the filler which is already confined in the wrapping material. The rate of removal of excess tobacco from the stream is regulated by changing the distance between the cutting element or elements of the equalizing device and the conveyor which transports the stream past the equalizing station.

The manufacturers of cigarettes strive to turn out cigarettes each of which contains a predetermined quantity of tobacco per unit length of the article. This is desirable on several grounds, especially in order to avoid the introduction of excessive quantities of expensive ingredient (tobacco) into the individual articles. The presently preferred technique involves the use of a monitoring device (e.g., a beta ray detector which employs a source of corpuscular radiation and an ionization chamber or another suitable transducer) which is placed adjacent to the path of the cigarette rod and furnishes signals denoting the monitored density of succesive increments of the advancing cigarette rod. The signals are utilized to effect adjustments of the equalizing device with reference to the aforementioned conveyor, i.e., to change the distance between the cutting plane and the conveyor and hence the height of the filler.

Prior to the invention and development of satisfactory monitoring devices which can ascertain the density of successive increments of a rapidly moving stream or filler consisting of tobacco and/or other fibrous smokable material and can transmit signals to a motor which is designed to instantaneously change the position of the equalizing device with reference to the conveyor for the tobacco stream, the cigarette making machines were devoid of equalizing means. In such antique machines, the tobacco stream was condensed by conveying it, at a gradually decreasing speed, through a tunnel wherein the stream was confined at all sides. Such compacting was to compensate for the inability of the cigarette making or analogous machine to immediately form a tobacco stream whose density is uniform and invariably matches or closely approaches an optimum value. The aforementioned reduction in the speed of forward movement of the tobacco stream was intended to reduce the dimensions of cavities between neighboring tobacco particles in the stream and to thus reduce the extent of deviation of density of the tobacco stream from an optimum value. Reference may be had, for example, to U.S. Pat. No. 2,671,452. It will be readily apparent that such rudimentary mode of reducing the extent to which the density of tobacco filler in a cigarette rod deviates from an optimum density is far from satisfactory and, therefore, all modern cigarette rod making and like machines are equipped with adjustable equalizing devices, with density monitoring devices, and with means for adjusting the equalizing devices when the monitored density deviates from an optimum value. Such devices and such adjusting means are standard components of all presently produced cigarette rod making machines.

The ability of a modern cigarette rod making machine to turn out cigarettes whose actual weight matches the prescribed weight is one of the criteria which are given foremost consideration by the purchasers of such machines. This stands to reason because a modern cigarette rod making machine, which can turn out in excess of 7000 cigarettes per minute, can save large sums of money if the actual weight of cigarettes which are produced therein matches the prescribed minimum acceptable weight.

Another criterion which is determinative of the quality and hence of the sales appeal of a modern cigarette rod making machine is its ability to turn out relatively hard or firm rod-shaped smoker's products. As a rule, a smoker will be unable to ascertain the exact quantity of tobacco in a cigarette. Instead, the smoker will judge the cigarette by ascertaining its firmness which is done by squeezing the cigarette between two fingers to thus determine the resistance which the filler offers to radial compacting. It is already known to ascertain the firmness of the fillers of cigarettes and to regulate the rate of removal of excess tobacco from the tobacco stream in dependency on deviation of the monitored firmness from an optimum or desirable firmness. Reference may be had to U.S. Pat. No. 3,411,513 which discloses a method and an apparatus for gauging and controlling firmness in cigarettes and the like.

It will be noted that all heretofore known proposals to regulate the weight or mass and the firmness of cigarettes involve an adjustment of the trimming or equalizing device with reference to the adjacent conveyor for the tobacco stream. The regulation of weight was considered more important and, therefore, the presently known cigarette rod making machines employ means for monitoring the density of cigarettes and means for adjusting the position of the equalizing device in response to signals which are furnished by such density monitoring means so that the position of the equalizing device is changed when the monitored density deviates from the optimum density. Attempts to regulate the firmness of cigarettes presently involve the provision of means for changing the firmness of tobacco particles, i.e., for influencing the characteristics of tobacco particles in the course of the so-called primary treatment which involves processing of tobacco prior to introduction into the magazine of a cigarette rod making machine. Such proposals involve so-called puffing of tobacco ribs and analogous treatment of tobacco particles ahead of the cigarette making station.

OBJECTS AND SUMMARY OF THE INVENTION

An object of the invention is to provide a novel and improved method of making a continuous rod wherein a web of cigarette paper or other suitable wrapping material surrounds and confines a rod-like filler, and of influencing the firmness of the filler at the time the rod is being produced without changing the quantity of tobacco per cigarette or an analogous rod-shaped smokers' product.

Another object of the invention is to provide a method which renders it possible to simultaneously regulate several parameters of the filler of a cigarette rod or the like in a simple and inexpensive way.

A further object of the invention is to provide a method which can be practiced by resort to a relatively simple machine whose design need not appreciably deviate from that of heretofore known machines.

An additional object of the invention is to provide a novel and improved machine which can be utilized for the practice of the above outlined method.

Another object of the invention is to provide the machine with novel and improved means for regulating the firmness of the rod in the machine proper, i.e., not in the primary processing equipment.

A further object of the invention is to provide a machine which can simultaneously monitor and regulate the firmness as well as at least one additional important characteristic of the rod.

Another object of the invention is to provide novel and improved adjusting means for use in a machine of the above outlined character.

An additional object of the invention is to provide the machine with novel and improved means for driving various conveyors for the transport of the tobacco stream and tobacco filler past various stations where the stream is formed and converted into a filler and where the filler is assembled with the wrapping material.

One feature of the invention resides in the provision of a method of making a continuous rod wherein a web of wrapping material (such as cigarette paper) confines a rod-like filler of smokable material, particularly tobacco. The method comprises the steps of forming a continuous stream consisting of smokable material and containing such material in excess of that which is required in the filler, advancing the stream lengthwise along a first portion and toward a second portion of a predetermined elongated path at a first speed, converting the advancing stream into a filler including removing the excess from the stream, introducing a web of wrapping material into and advancing the thus introduced web along the second portion of the path at a lesser second speed, draping the advancing web around the advancing filler with attendant formation of the aforementioned rod, and decelerating the filler from the first to the second speed prior to completion of the draping step with attendant condensation or compression of successive increments of the filler.

The method preferably further comprises the steps of monitoring the density of successive increments of the filler (preferably of the wrapped filler) and adjusting the removing step as a function of changes in the monitored density of the filler. The method preferably further includes the steps of regulating at least one of the first and second speeds and the extent of deceleration of the filler from the first to the second speed. The draping step preferably comprises subjecting the filler to the action of radial compacting forces with attendant reduction of the cross-sectional area of the filler. Such radial compacting takes place by way of the relatively slow wrapping material so that the filler is necessarily decelerated from the first to the second speed. Such deceleration entails an axial or longitudinal compacting of the filler in the region where the filler is compelled to advance at the second (rather than at the first) speed.

The method preferably further comprises the steps of monitoring the firmness of the draped filler and regulating the decelerating step as a function of changes of monitored firmness of the filler. Such monitoring step can include deforming the draped filler and ascertaining the extent of deformation. This can be achieved by directing against the wrapping material one or more streams or jets of compressed air or another gaseous fluid so that the wrapping material is deformed to an extent which is a function of firmness of the adjacent portion of the confined filler, and measuring the extent of deformation of the wrapping material. Alternatively, the step of monitoring the firmness of the filler can comprise monitoring a parameter of the filler prior to the draping step, e.g., monitoring the height of the filler (namely, the distance between the conveyor which advances the stream and the filler toward the draping station and that (exposed) surface of the filler which faces away from such conveyor). Removal of excess smokable material normally takes place in a plane which is disposed at a variable distance from the stream conveyor, and the monitoring step then includes or can include measuring the distance between such plane and the respective conveyor. The measurement is preferably carried out by instrumentalities (such as an optoelectronic detector) whose parts do not contact the stream and/or the filler. The firmness monitoring step can include comparing the monitored firmness with a predetermined range of firmnesses and the regulating step can comprise respectively reducing and increasing the quantity of smokable material per unit length of the filler when the monitored firmness is respectively above a maximum and below a minimum firmness within the aofrementioned range. The method can include comparing the monitored density of the filler with a predetermined density and adjusting the removing step when the monitored density deviates from the predetermined density; such adjustment can involve changing the predetermined value of density or correcting the monitored density value prior to adjustment of the removing step.

Another feature of the invention resides in the provision of a machine for making a continuous rod wherein a web of wrapping material confines a rod-like filler of smokable material, particularly tobacco. The machine comprises a transporting unit which defines an elongated path and includes first and second conveyor means disposed one behind the other, as considered in the longitudinal direction of the path, means for respectively driving the first and second conveyor means at a higher first and a lower second speed, a suction duct, an impeller and/or other suitable means for supplying smokable material to the first conveyor means so that the latter accumulates a continuous stream of smokable material containing such material in excess of that which is required in the filler and advances the stream along the path toward the second conveyor means, adjustable equalizing means adjacent to the first conveyor means and serving to remove the excess from the stream so that the latter is converted into a filler which advances toward the second conveyor means and is decelerated and compressed as a result of transfer onto the slower second conveyor means, means for supplying the wrapping material between the second conveyor means and the filler, and means for draping the wrapping material around the filler on the second conveyor means so that the filler and the wrapping material form a rod.

The machine preferably further comprises means for adjusting the ratio of the first and second speeds. Still further, the machine preferably comprises means for monitoring the density of the filler and means for adjusting the equalizing means when the monitored density deviates from a predetermined value. The driving means preferably comprises a prime mover for one of the conveyor means and variable-speed transmission means receiving motion from the prime mover and serving to drive the other conveyor means. The arrangement may be such that the prime mover means is operatively connected with both conveyor means and the transmission is installed in one of the operative connections. Alternatively, the prime mover can drive one of the conveyor means and the one conveyor means can drive the other conveyor means by way of the variable-speed transmission.

The machine further comprises means for monitoring the firmness or hardness of the filler (preferably downstream of the draping means) and means for varying the ratio of the transmission in response to deviations of the monitored firmness from a predetermined value. The firmness monitoring means can comprise means for directing air or another gaseous fluid against the wrapping material which confines the filler whereby the fluid deforms the wrapping material to an extent which is a function of firmness of the adjacent portion of the confined filler, and means for generating signals which denote the extent of deformation of the wrapping material under the action of the gaseous fluid. Alternatively, the monitoring means which ascertains the firmess of the filler can comprise means for measuring a transverse dimension of the undraped filler, preferably the distance between the first conveyor means and that exposed surface of the filler which faces away from the first conveyor means and is formed by the equalizing means as a result of removal of excess from the stream. Such measuring means preferably comprises or constitutes a contact-free detector (e.g., an optoelectronic measuring device), namely, a detector whose parts need not contact the filler in order to ascertain the distance between the aforementioned exposed surface and the first conveyor means.

The aforementioned adjusting means can adjust the equalizing means with reference to the first conveyor means in response to deviations of monitored firmness of the filler from a predetermined range of acceptable firmnesses. Thus, one and the same adjusting means can be used to change the position of the equalizing means relative to the first conveyor means in response to deviation of monitored firmness of the filler from a desirable range of firmnesses or in response to deviation of monitored density of the filler from a predetermined value, e.g., a predetermined range of acceptable densities.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is a schematic view of modified driving means for the first and second conveyor means;

DESCRIPTION OF THE PREFERRED EMBODIMENTS

Figure 1:
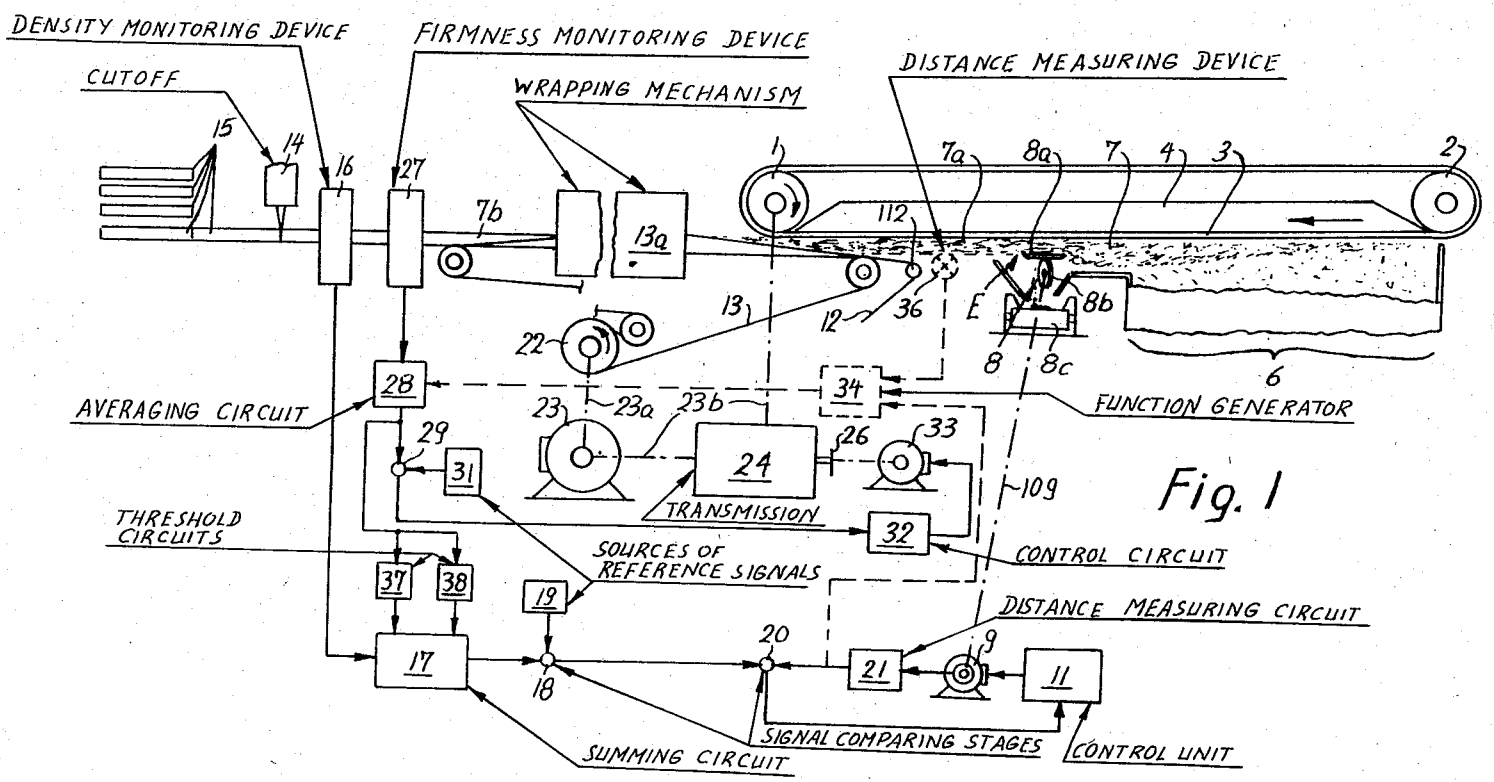
FIG. 1 is a fragmentary schematic partly elevational and partly longitudinal vertical sectional view of a machine which embodies one form of the invention, the operative connections between a first prime mover and the two conveyor means as well as between a second prime mover and the equalizing means being indicated by phantom lines and certain optional monitoring means being indicated by broken lines.

The cigarette rod making machine which is shown in FIG. 1 comprises a duct 6 which supplies a shower of tobacco particles TP toward the underside of the lower reach of an elongated narrow belt conveyor 3 consisting of a foraminous material. The conveyor 3 is trained over pulleys 1 and 2 and its lower reach advances below the open underside of a suction chamber 4 so that it attracts the tobacco particles TP which ascend in the duct 6. Such particles form a growing tobacco stream which is fully grown in the region at the left-hand side of the outlet of the duct 6. The fully grown tobacco stream 7 is advanced in the direction which is indicated by the arrow A and moves past a vertically adjustable trimming or equalizing device 8 which is disposed at an equalizing station E and serves to remove the excess of tobacco, namely, the particles or fragments of particles which extend downwardly beyond the substantially horizontal plane of a rotary disc-shaped cutter or beyond two cooperating disc-shaped tobacco clamping discs or wheels **8*a* (only one shown) cooperating with a rotary brush or paddle wheel 8*b* to remove the excess which descends onto a conveyor 8*c* serving to return the removed excess to the magazine (not shown) of the cigarette rod maker. The particles PT of tobacco which advance within the confines of the duct 6 can be drawn upwardly by the suction chamber 4** and/or propelled upwardly by a suitable rotary impeller (e.g., a picker roller) in a manner not forming part of the present invention. Details of an equalizing device which can be used in the machine of the present invention are disclosed, for example, in U.S. Pat. No. 3,030,966.

The distance between the tobacco clamping discs **8*a* and the lower reach of the conveyor 3 can be regulated by an adjusting device including a reversible motor 9 which can lift or lower the equalizing device 8 by way of a suitable operative connection 109. Such motors and connections are well known and are in actual use in practically all modern cigarette rod making machines. The motor 9 receives signals from a control unit 11 which can cause the motor 9 to move the equalizing device 8** up or down, depending upon the nature of signals which are transmitted thereto by the monitoring means of the improved machine.

By removing the excess of smokable material, the equalizing device 8 converts the fully grown tobacco stream 7 into a filler *7a* whose bottom surface or underside faces away from the lower reach of the conveyor 3 and is spaced apart from this conveyor by a distance corresponding to that between the upper sides of the tobacco clamping discs *8a* and the underside of the lower reach of the conveyor 3.

A second endless band or belt conveyor 13 is disposed downstream of the conveyor 3, as considered in the direction of arrow A, and serves to accept successive increments of the filler *7a* as well as successive increments of a web 12 of cigarette paper or other suitable wrapping material. The web 12 is supplied by a source including a roller of wheel 112 which is located slightly upstream of the upper reach of the conveyor 13 at a level below the left-hand portion of the lower reach of the conveyor 3. The conveyors 3 and 13 constitute an elongated transporting unit which defines for the stream 7, for the filler *7a* and for a continuous cigarette rod *7b* an elongated path wherein the smokable material advances in the direction of arrow A. The conveyor 13 advances the web 12 and the filler *7a* through a wrapping or draping mechanism *13a* wherein the web 12 is draped around the filler *7a* to form therewith the aforementioned continuous rod *7b*. The leader of the rod *7b* is severed at regular intervals by a conventional cutoff 14 so that it yields a file of discrete plain cigarettes 15 of unit length or multiple unit length, and such file is then converted into one or more rows for transport of cigarettes 15 into a packing machine, into storage, or into filter tipping machine wherein the cigarettes are united with filter mouthpieces to form therewith filter cigarettes of unit length or multiple unit length.

The wrapping mechanism *13a* is of known design, and its purpose is to drape the web 12 around the filler *7a* and to simultaneously subject the filler to the action of radial compressing or compacting forces, i.e., the diameter or cross-sectional area of the filler *7a* is reduced and the thus compacted filler tends to expand the tubular envelope which is obtained by draping the web 12 around the filler and by causing the overlapping marginal portions of the draper web to form a seam extending in parallelism with the axis of the cigarette rod *7b*. The seam is formed in a well known manner by coating one marginal portion of the web 12 with a suitable adhesive and by thereupon folding the adhesive-coated marginal portion over the other marginal portion of the web. The seam is thereupon heated or cooled (depending on the nature of the adhesive) to cause the adhesive to set and to thus enable the seam to stand the stresses which arise as a result of the tendency of the confined filler *7a* to expand as well as during severing of the rod *7b* by the knife or knives of the cutoff 14.

The illustrated machine further comprises a monitoring device 16 which is adjacent to the path of movement of the rod *7b* downstream of the conveyor 13 and serves to ascertain the density of successive increments of the compacted filler *7a* in the rod *7b*. The monitoring device 16 can comprise a source of corpuscular radiation (e.g., beta rays) at one side of the path of movement of the rod *7b* and an ionization chamber or another suitable transducer at the other side of such path opposite the source of radiation. The signals which are generated by the ionization chamber are indicative of the monitored density of the respective increments of the condensed and confined filler *7a* and are transmitted to the input of a summing circuit 17. The signals which are transmitted by the output of the summing circuit 17 are used to regulate the extent to which the equalizing device 8 removes the excess of tobacco at the station E below the lower reach of the conveyor 3. It will be noted that the monitoring device 16 ascertains the density of successive increments of the confined filler *7a*, namely, of a filler whose cross-sectional area is at least substantially constant and is determined by the diameter of the tubular envelope which is obtained by draping the web 12 around the filler and by thereupon bonding the marginal portions of the draped web to one another.

The signals which appear at the output of the summing circuit 17 are transmitted to a signal comparing stage 18 which is further connected with the output of a source 19 of reference signals denoting the desired or optimum density of tobacco in the compacted filler *7a* of the cigarette rod *7b*. The output of the comparing stage 18 transmits a signal which denotes the extent of deviation of desired or optimum density of the filler *7a* from the actual or monitored density. Such signal is transmitted to a first input of a second signal comparing stage 20. A second input of the stage 20 receives signals from a distance measuring circuit 21 which is connected with the motor 9 and whose output transmits signals denoting the actual distance between the plane of the tobacco clamping discs *8a* and the underside of the lower reach of the conveyor 3, i.e., such output signals are indicative of the height of the undraped filler *7a* at the underside of the lower reach of the conveyor 3 immediately downstream of the equalizing station E. The signal which is generated by the stage 20 is transmitted to the input of the control unit 11 which adjusts the position of the equalizing device 8 with reference to the conveyor 3, i.e., the motor 9 adjusts the distance between the plane of the discs *8a* and the underside of the lower reach of the conveyor 3. The distance measuring circuit 21 can comprise or constitute an inductor whose iron core moves axially within a coil in response to movement of the equalizing device 8 with reference to the conveyor 3 to thereby change the inductance of the coil. Such distance measuring devices are well known and are available on the market. Transmission of signals from the comparing stage 20 to the control unit 11 for the motor 9 is terminated or interrupted when the difference between the intensities and/or other characteristics of signals which the stage 20 receives from the stage 18 and from the distance measuring circuit 21 is reduced to zero or below a certain minimum value. It will be noted that the circuit 21 is designed to indirectly ascertain the level of the equalizing device 8 by way of the motor 9. However, it is equally within the purview of the invention to resort to a distance measuring device which is mounted directly on the equalizing device 8 and continuously generates signals denoting the momentary distance between the equalizing device and the lower reach of the conveyor 3. The intensity of the reference signal which is transmitted by the source 19 is indicative of the optimum density of the filler *7a*, and the adjustment of the level of the equalizing device 8 is terminated when the intensity of signal which is transmitted by the stage 18 (such signal is influenced by the reference signal from 19) is matched by the intensity of signal from the circuit 21.

The means for driving the conveyors 3 and 13 comprises a common prime mover 23, a so-called format wheel 22 which transmits motion to the conveyor 13 and is operatively connected (at 23*a*) with the output element of the prime mover 23, an operative connection 23*b* between the output element of the prime mover 23 and the pulley 1 for the conveyor 3, and a variable-speed transmission 24 which is installed in or forms part of the operative connection 23*b*. Each operative connection can comprise a gear train, a belt drive or any other suitable torque transmitting means. The prime mover 23 can constitute the main prime mover of the cigarette rod making machine which embodies the illustrated structure.

Figure 3:
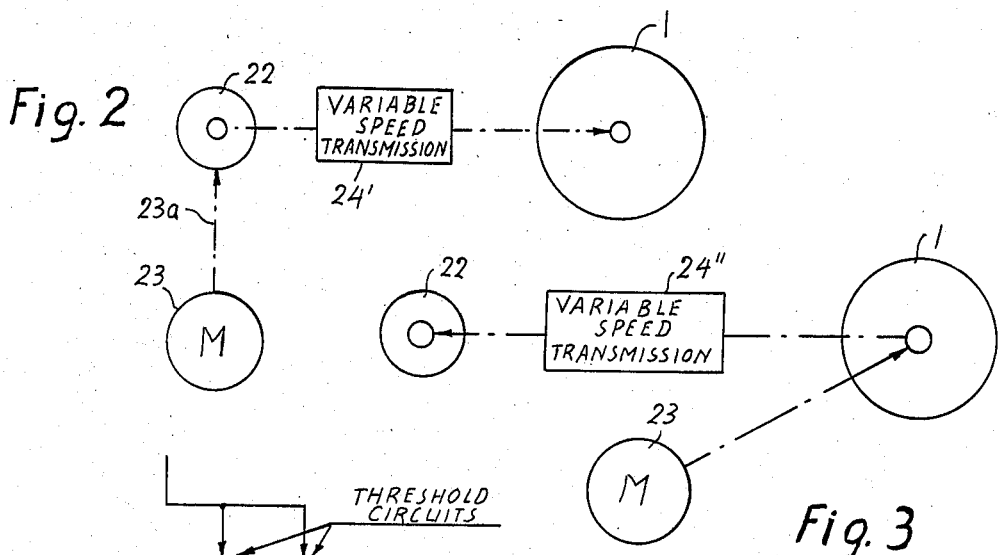
FIG. 3 is a schematic view of additional driving means.

In presently known cigarette rod making and analogous machines, the main prime mover of the machine drives the first conveyor (corresponding to the illustrated conveyor 3) at the exact speed of the second conveyor (corresponding to the conveyor 13). As a rule, the output element of the main prime mover is rigidly connected with the input elements of the two conveyors. In contrast to such conventional design, the means for driving the conveyors 3 and 13 is designed to drive the conveyor 3 at a first speed and to drive the conveyor 13 at a lower second speed. The transmission 24 is preferably an infinitely variable-speed transmission which can be operated to change the ratio of the first and second speeds within a desired range. It is to be noted that the illustrated means for driving the conveyors 3 and 13 can be modified in a number of ways without departing from the spirit of the invention. For example, the output element of the common prime mover 23 can drive the wheel 22 which, in turn, drives the pulley 1 by way of a variable-speed transmission 24′ corresponding to the transmission 24 (see FIG. 2). Alternatively, the prime mover 23 can drive the pulley 1 which then drives the wheel 22 through the medium of a variable-speed transmission 24″ (see FIG. 3).

The ratio of the transmission 24 can be changed by hand through the medium of a handwheel 26 so that the speed of the conveyor 3 slightly exceeds the speed of the conveyor 13. This entails a certain amount of axial compression or compacting of the filler 7*a* during transfer from the lower reach of the conveyor 3 (to which the filler 7*a* is attracted by suction) onto the web 12 of wrapping material on the upper reach of the conveyor 13 and/or upon arrival of successive increments of the filler 7*a* into the draping mechanism 13*a*. Such slight axial compacting of the filler 7*a* entails a certain increase of firmness or hardness of the filler 7*a* in the tubular envelope which forms part of the rod 7*b*. The just discussed compacting does not entail an increase in the weight of the tobacco filler section in a cigarette 15. This is due to the fact that the change in density of tobacco in the filler 7*a* (such as develops as a result of the just discussed difference between the speeds of the conveyors 3 and 13) is detected by the monitoring device 16 which effects a density change in the aforedescribed manner via summing circuit 17, signal comparing stages 18, 20 and control unit 11.

The machine of FIG. 1 further comprises a second monitoring device 27 which is installed between the wrapping mechanism 13*a* and the monitoring device 16 and comprises means for continuously ascertaining the firmness of successive increments of the confined filler 7*a*, i.e. of that portion of the filler which forms part of the cigarette rod 7*b*. The monitoring device 27 can be associated or provided with a display unit which furnishes visible indications denoting the monitored firmness of the confined filler 7*a*. This enables an attendant to influence the firmness (if the monitored firmness deviates from an optimum value) by way of the handwheel 26. A device which can be used to monitor the firmness of successive increments of a confined tobacco filler is disclosed, for example, in commonly owned U.S. Pat. No. 3,595,067. The disclosure of this patent is incorporated herein by reference. The patented firmness monitoring device comprises an annular nozzle which directly compressed air against successive increments of the tubular envelope forming part of a cigarette rod whereby the envelope undergoes deformation which is inversely proportional to the firmness of the adjacent increments of the confined filler. The extent to which the tubular envelope is deformed by the stream or streams of compressed air is detected by a suitable measuring device, e.g., an optoelectronic transducer which is preferably designed to remain out of contact with the running cigarette rod.

The firmness monitoring device 27 is preferably further designed to automatically eliminate or compensate for long-range fluctuations of the firmness of a confined filler. To this end, the output of the transducer of the monitoring device 27 transmits signals to an averaging circuit 28 whose output transmits signals denote the average hardness of certain lengths of the filler 7*a*. For example, the averaging circuit 28 can be designed to generate output signals denoting the average firmness of a certain number of successively produced plain cigarettes 15 or the average firmness of cigarettes which are produced within a selected interval of time. The signal which denotes the average firmness of a certain number of cigarettes 15 is transmitted to one input of a signal comparing stage 29 another input of which receives a reference signal from a suitable source 31, e.g., an adjustable potentiometer. The output of the comparing stage 29 transmits a signal when the intensity and/or another characteristic of the signal from the averaging circuit 28 deviates from the intensity of the reference signal. The signal which appears at the output of the stage 29 is transmitted to a control circuit 32 for a reversible motor 33 which can rotate the wheel 26 clockwise or counterclockwise to thereby adjust the ratio of the transmission 24 as a function of deviation of average firmness from the optimal firmness. The frequency of signals which are transmitted by the averaging circuit 28 is selected in such a way that the motor 33 adjusts the handwheel 26, and thus the ratio of the transmission 24, in order to eliminate long-range deviations of firmness from an optimum firmness of the confined filler 7*a*.

Commonly owned U.S. Pat. No. 4,280,516 discloses that it is possible to indirectly ascertain the firmness of the filler in a cigarette rod or the like. For example, it is possible to ascertain the height of the undraped filler and to calculate the firmness on the basis of such measurement in accordance with a certain function. Thus, the monitoring device 27 can be used instead of or in addition to a function generator 34 one input of which is connectable with the output of the distance measuring circuit 21 and another input of which is connectable with an optoelectronic distance measuring device 36 of the type disclosed in the aforementioned U.S. Pat. No. 4,280,516. The disclosure of this patent is incorporated herein by reference. The optoelectronic measuring device is but one of the various measuring devices which are disclosed in this patent and can be used in the machine of the present invention.

As a rule, changes in the ratio of the speeds of the conveyors 3 and 13 allow for regulation of the firmness of the confined filler *7a* within a certain range. Therefore, the output of the averaging circuit 28 is connected not only to the signal comparing stage 29 but also to the inputs of two threshold circuits 37 and 38. The circuit 37 is designed to transmit to the summing circuit 17 a signal when the intensity or another characteristic of the signal from the monitoring device 27 (denoting the firmness of the confined filler *7a*) is below a predetermined range of firmnesses. On the other hand, the threshold circuit 38 is designed to transmit to the summing circuit 17 a signal only when the intensity of signal from the averaging circuit 28 is above the aforementioned range. The signal from the circuit 37 is transmitted to the summing circuit 17 with a negative sign, i.e., the intensity of signal at the output of the summing circuit 17 is reduced when the signal from the output of the circuit 37 denotes that the firmness of the filler *7a* is sufficient. This modifies the signal at the output of the summing circuit 17 in a sense to indicate to the stage 18 that the density of the confined filler *7a* is insufficient whereby the motor 9 is caused to lower the equalizing device 8 in order to increase the quantity of tobacco particles TP per unit length of the undraped filler *7a*. In other words, the signal which the summing circuit 17 transmits to the corresponding input of the signal comparing stage 18 "falsely" represents a signal denoting an increment of the filler *7a* whose density is too low. As soon as the motor 9 effects an increase of the cross-sectional area of the undraped filler *7a* (by moving the equalizing devices 8 downwardly and further away from the lower reach of the conveyor 3), the firmness of the draped filler *7a* increases automatically because the diameter of the draped filler *7a* is the same as prior to downward movement of the equalizing device. The provision of threshold circuit 38 prevents the firmness of the draper filler *7a* from increasing beyond an optimum or maximum acceptable value. The output of the circuit 38 transmits to the summing circuit 17 a positive signal when the monitored firmness of the draper filler *7a* is excessive, and such signal is added to the signal from the monitoring device 16 so that the apparent density of the draped filler is higher than the actual density. This induces the comparing stage 18 to transmit a signal which initiates an upward movement of the equalizing device 8 and a corresponding reduction of the cross-sectional area of the undraped filler *7a*. Consequently, the firmness of the draped filler *7a* is reduced, and this induces the averaging circuit 28 to cause the threshold circuit 38 to interrupt the transmission of a signal (with a positive sign) to the corresponding input of the summing circuit 17.

Of course, it is equally possible to operatively connect the threshold circuits 37 and 38 with the source 19 of reference signals and to adjust the intensity and/or another characteristic of the reference signal which is transmitted to the stage 18 whenever the source 19 receives a signal from the circuit 37 or 38. The result is the same, i.e., the equalizing device 8 is lowered when the firmness is less than the lowermost firmness of a range of acceptable firmnesses, and the equalizing device 8 is lifted when the monitored firmness is greater than the maximum firmness of the acceptable range of firmnesses. The summing circuit 17 is then preferably disposed between the source 19 of reference signals and the stage 18 and the signs of signals at the outputs of the threshold circuits 37 and 38 are reversed. This is shown schematically in FIG. 4.

Figure 5:
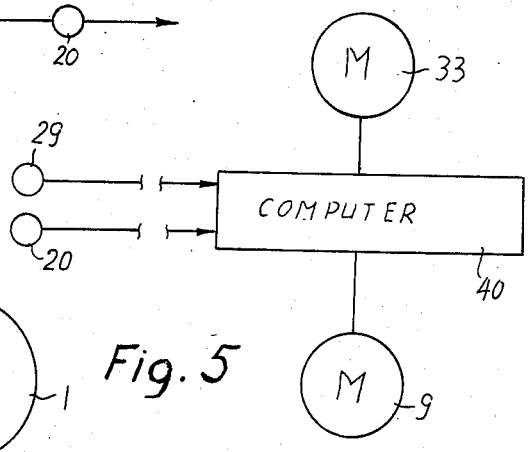
FIG. 5 is a diagrammatic view of modified means for regulating the ratio of the speeds of the two conveyor means and for adjusting the equalizing device.
Figure 6:
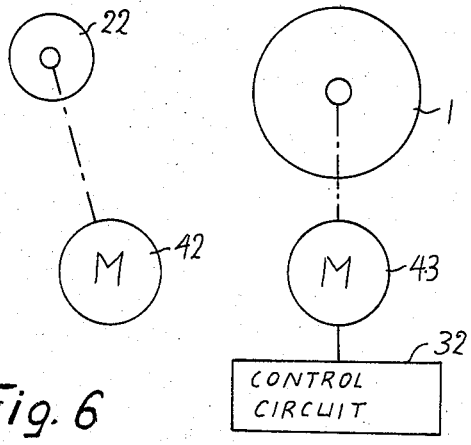
FIG. 6 is a schematic view of further driving means for the first and second conveyor means.

It is also possible to resort to a computer 40 (see FIG. 5) which regulates the ratio of the transmission 24 and adjusts the motor 9 for the equalizing device 8 in such a way that the consumption of tobacco is reduced to a minimum while the firmness of the confined filler *7a* still remains acceptable. Furthermore, and as shown in FIG. 6, it is equally possible to provide discrete motors 42 and 43 for the wheel 22 and pulley 1. At least one of these motors (e.g., the motor 43) is then a variable-speed motor whose speed can be regulated (by control circuit 32) in order to change the ratio of the speeds of conveyors 3 and 13 and to thereby change the firmness of the confined filler.

An important advantage of the improved method and machine is that the firmness of the confined filler *7a* can be regulated in the rod making machine proper, i.e., it is not necessary to influence the particles of tobacco ahead of the stream forming zone. Each reduction of the speed of the conveyor 13 relative to the speed of the conveyor 13, or each increase of the speed of the conveyor 3 relative to the speed of the conveyor 13, initially entails an increase of the quantity of tobacco particles per unit length of the confined filler *7a* because the filler undergoes additional axial compression at the locus of transition of the speed of the filler *7a* from the higher first to the lower second speed. However, such increase of the quantity of tobacco per unit length of the draped filler *7a* is only temporary and short-lasting because the monitoring device 16 detects the increased density of the filler within the confines of the tubular envelope and effects a change in the level of the equalizing device 8 relative to the lower reach of the conveyor 3 to thereby reduce the quantity of tobacco per unit length of the undraped filler *7a*. The improved method and machine have been found to increase the firmness of the confined filler by more than 10 percent without increasing the consumption of tobacco. This means that tobacco particles whose filling power or firmness is relatively low can be used for the making of a cigarette rod whose filler is firm by the simple expedient of subjecting the filler *7a* to axial compressive stresses while the filler changes its speed from that of the first conveyor 3 to that of the second conveyor 13. When the filling power of tobacco particles which are supplied by the duct 6 is satisfactory, the same procedure can entail a considerable reduction of tobacco consumption without reducing the firmness of the confined filler below the acceptable range of firmnesses.

The improved method and machine render it possible to automatically compensate for fluctuations of firmness from tobacco brand to tobacco brand by the simple expedient of changing the ratio of speeds of the conveyors 3 and 13, i.e., by reducing the speed of the filler not later than on completion of the draping operation. Moreover, such method and machine render it possible to account for unpredictable and random changes of certain other parameters which can influence the firmness of the confined filler. Such parameters include the moisture content and the temperature of tobacco. Still further, the improved method and machine render it possible to ensure that the firmness of the confined filler remains constant and matches an optimum firmness and/or that the quantity of consumed tobacco is held to a minimum without reducing the firmness of the confined filler below the minimum acceptable value.

Still another important advantage of the improved method and machine is that they allow for simultaneous regulation of the density and firmness of the confined filler and that such simultaneous regulation does not entail a less satisfactory regulation of the firmness than that of the density and/or vice versa. This is due to the fact that the ratio of speeds of the conveyors 3 and 13 is regulated solely in dependency on the monitored firmness of the confined filler 7*a*. As mentioned above, the firmness of the confined filler can be monitored in any suitable way, preferably by deforming the tubular envelope for the confined filler by means of one or more streams or jets of compressed gaseous fluid. However, if such monitoring of the firmness is impossible or impractical in a certain machine, the firmness can be ascertained indirectly by the aforementioned expedient of measuring the distance between the plane of the clamping discs 8*a* and the underside of the lower reach of the conveyor 3 and/or by contact-free monitoring of the level of the exposed lower surface or underside of the undraped filler 7*a* at the underside of the conveyor 3 downstream of the equalizing station E.

Figure 4:
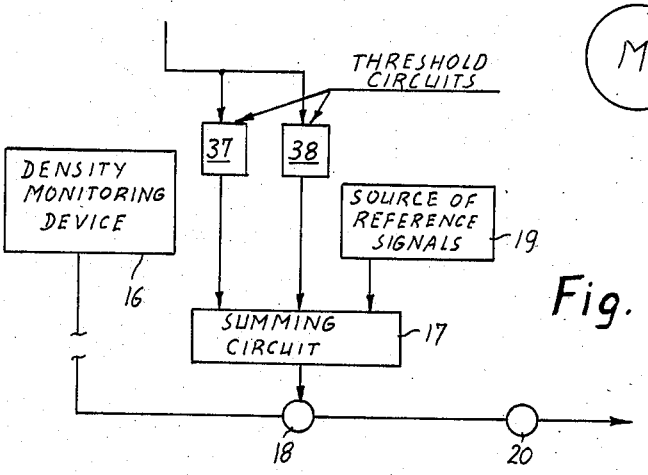
FIG. 4 is a diagrammatic view of a modified connection between the firmness monitoring means and the means for adjusting the equalizing means.

The firmness of a confined filler 7*a* is likely to change even if the type of tobacco particles, the moisture content of tobacco and/or the temperature of tobacco remains unchanged. For example, the firmness of the confined filler also depends upon the length of tobacco shreds and/or other constituents of the filler. The threshold circuits 37 and 38 account for such potential changes of firmness by automatically inducing the motor 9 to change the level of the equalizing device 8 and to thus change the quantity of tobacco per unit length of the undraped filler (and hence the firmness of the confined filler) when the ascertained firmness is respectively below and above the acceptable range of firmnesses. This further ensures that the actual firmness of the confined filler approaches or matches the optimum firmness, namely, a firmness which is preferably only slightly greater than the minimum acceptable firmness. As a rule, such adjustments are made only to counteract long-range deviations of monitored firmness from the desired value or range of values. As also mentioned above, the adjustment via threshold circuits 37 and 38 can be effected by changing the actual value of the monitored firmness (i.e., by transmitting signals to a summing circuit 17 which is located ahead of the stage 18) or by changing the optimum value of the firmness (i.e., by placing the summing circuit 17 between the source 19 of reference signals and the stage 18 as shown in FIG. 4 so that the circuits 37 and 38 can influence the intensity and/or another characteristic of the reference signal).

The utilization of a common prime mover (23) for the conveyors 3 and 13 is advisable and advantageous because this entails a reduction of initial and maintenance cost and renders it possible to employ relatively simple and compact driving means. However, and as explained hereinabove and as shown in FIG. 6, it is also possible to employ two discrete prime movers and to construct at least one of these prime movers in such a way that it can change the speed of the respective conveyor with reference to the speed of the other conveyor. As further explained above, it is possible to monitor the firmness of the filler downstream of the draping mechanism 13*a* (e.g., by resorting to the monitoring device 27 which ascertains the firmness of successive increments of the confined filler 7*a*) and/or to indirectly monitor the firmness of the confined filler 7*a* upstream of the wrapping mechanism by resorting to the photoelectronic measuring device 36 and/or to the measuring device 21. The selection of one or more of these or analogous firmness monitoring devices depends on the availability of suitable devices and/or on space considerations and/or on the accessibility of various devices in a certain type of cigarette making or like machine. Any firmness monitoring device in excess of a single device constitutes an optional but desirable feature of the improved machine. The same holds true for the threshold circuits 37 and 38 which can influence the distance between the equalizing device 8 and the lower reach of the conveyor 3 by way of the comparing stages 18, 20, control circuit 11 and motor 9.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptions should and are intended to be comprehended within the meaning and range of equivalence of the appended claims.

I claim:

1. A method of making a continuous rod wherein a web of wrapping material confines a rod-like filler of smokable material, particularly tobacco, comprising the steps of forming a continuous stream consisting of smokable material and containing such material in excess of that which is required in the filler; advancing the stream lengthwise along a predetermined path at a first speed; converting the advancing stream into a filler including removing the excess therefrom; introducing the web of wrapping material into and advancing the web lengthwise along said path at a lesser second speed; draping the advancing web around the advancing filler with attendant formation of said rod; decelerating the filler from said first to said second speed prior to completion of said draping step with attendant condensation of successive increments of the filler; monitoring the density of successive increments of the filler; and adjusting said removing step as a function of changes of monitored density of the filler.

2. The method of claim 1, wherein said monitoring step includes ascertaining the density of successive increments of the wrapped filler.

3. The method of claim 1, wherein said draping step comprises subjecting the filler to the action of substantially radial compacting forces with attendant reduction of the cross-sectional area of the filler.

4. A method of making a continuous rod wherein a web of wrapping material confines a rod-like filler of smokable material, particularly tobacco, comprising the steps of foming a continuous stream consisting of smokable material and containing such material in excess of that which is required in the filler; advancing the stream lengthwise along a predetermined path at a first speed; converting the advancing stream into a filler including removing the excess therefrom; introducing the web of wrapping material into and advancing the web lengthwise along said path at a lesser second speed; draping the advancing web around the advancing filler with attendant formation of said rod; decelerating the filler from said first to said second speed prior to completion of said draping step with attendant condensation of successive increments of the filler; monitoring the firmness of the draped filler; and regulating said decelerating step as a function of changes in the monitored firmness of the filler.

5. The method of claim 4, wherein said monitoring step includes deforming the draped filler and ascertaining the extent of deformation of the filler.

6. The method of claim 4, wherein said monitoring step includes monitoring a parameter of the filler prior to said draping step.

7. The method of claim 6, wherein said parameter is the height of the undraped filler.

8. The method of claim 6, wherein said step of advancing the stream includes transporting the stream by a conveyor and said converting step includes removing the excess of smokable material in a plane which is disposed at a variable distance from the conveyor, said monitoring step including measuring the distance between the conveyor and said plane.

9. The method of claim 6, wherein said monitoring step includes ascertaining the height of successive increments of the undraped filler without contacting the filler.

10. The method of claim 4, wherein said monitoring step includes comparing the monitored firmness with a predetermined range of firmnesses and said regulating step includes respectively reducing and increasing the quantity of smokable material per unit length of the filler when the monitored firmness is respectively above the maximum and below the minimum firmness within said range.

11. The method of claim 10, further comprising the steps of monitoring the density of successive increments of the filler, comparing the monitored density with a predetermined density, and adjusting said removing step when the monitored density deviates from said predetermined density, said step of adjusting said regulating step including changing said predetermined value.

12. The method of claim 10, further comprising the steps of monitoring the density of successive increments of the filler and adjusting said removing step as a function of changes of monitored density of the filler, said quantity increasing and reducing step including correcting the monitored density value prior to adjustment of said removing step.

13. A machine for making a continuous rod wherein a web of wrapping material confines a rod-like filler of smokable material, particularly tobacco, comprising a transporting unit defining an elongated path and including first and second conveyor means disposed one after the other, as considered in the longitudinal direction of said path; means for respectively driving said first and second conveyor means at a higher first and a lower second speed; means for supplying smokable material to said first conveyor means so that the latter accumulates a continuous stream of smokable material containing such material in excess of that required in the filler and advances the stream along said path; adjustable equalizing means adjacent to said first conveyor means and arranged to remove the excess from the stream so that the latter is converted into a filler which advances toward said second conveyor means and is decelerated and compressed as a result of transfer onto said second conveyor means; means for monitoring the density of the filler; means for adjusting said equalizing means when the monitored density deviates from a predetermined value; means for supplying the wrapping material between the filler and the second conveyor means; and means for draping the wrapping material around the filler on said second conveyor means so that the filler and the wrapping material form a rod.

14. The machine of claim 13, wherein said driving means comprises a prime mover for one of said conveyor means and variable-speed transmission means receiving motion from said prime mover and arranged to drive the other of said conveyor means.

15. The machine of claim 13, wherein said one conveyor means is arranged to drive the other of said conveyor means and said transmission means is disposed between said one and said other conveyor means.

16. A machine for making a continuous rod wherein a web of wrapping material confines a rod-like filler of smokable material, particularly tobacco, comprising a transporting unit defining an elongated path and including first and second conveyor means disposed one after the other, as considered in the longitudinal direction of said path; means for respectively driving said first and second conveyor means at a higher first and a lower second speed; means for supplying smokable material to said first conveyor means so that the latter accumulates a continuous stream of smokable material containing such material in excess of that required in the filler and advances the stream along said path; adjustable equalizing means adjacent to said first conveyor means and arranged to remove the excess from the stream so that the latter is converted into a filler which advances toward said second conveyor means and is decelerated and compressed as a result of transfer onto said second conveyor means; means for monitoring the firmness of the filler; means for adjusting said driving means in response to deviations of the monitored firmness from a predetermined value; means for supplying the wrapping material between the filler and the second conveyor means; and means for draping the wrapping material around the filler on said second conveyor means so that the filler and the wrapping material form a rod.

17. The machine of claim 16, wherein said monitoring means is disposed downstream of said draping means and is arranged to ascertain the firmness of the draped filler.

18. The machine of claim 17, wherein said monitoring means includes a device for directing a gaseous fluid against the wrapping material which confines the filler whereby the fluid deforms the wrapping material to the extent which is a function of the firmness of the adjacent portion of the confined filler, and means for generating signals denoting the extent of deformation of the wrapping material.

19. The machine of claim 16, wherein said monitoring means includes means for measuring a transverse dimension of the undraped filler.

20. The machine of claim 19, wherein the undraped filler has an exposed surface facing away from the first conveyor means and said measuring means is arranged to ascertain such distance.

21. The machine of claim 20, wherein said surface of the filler is formed by the equalizing means as a result of removal of excess smokable material from the stream and said measuring means includes means for ascertaining the distance between said equalizing means and said first conveyor means.

22. The machine of claim 21, wherein said measuring means comprises a contact-free detector.

23. The machine of claim 22, wherein said detector includes an optoelectronic measuring device.

24. A machine for making a continuous rod wherein a web of wrapping material confines a rod-like filler of smokable material, particularly tobacco, comprising a transporting unit defining an elongated path and including first and second conveyor means disposed one after the other, as considered in the longitudinal direction of said path; means for respectively driving said first and second conveyor means at a higher first and a lower second speed; means for supplying smokable material to said first conveyor means so that the latter accumulates a continuous stream of smokable material containing such material in excess of that required in the filler and advances the stream along said path; adjustable equalizing means adjacent to said first conveyor means and arranged to remove the excess from the stream so thath the latter is converted into a filler which advances toward said second conveyor means and is decelerated and compressed as a result of transfer onto said second conveyor means; means for monitoring the firmness of the filler; means for comparing the monitored firmness with a predetermined range of firmnesses; means for adjusting said equalizing means with reference to said first conveyor means when the monitored firmness is outside of said range; means for supplying the wrapping material between the filler and the second conveyor means; and means for draping the wrapping material around the filler on said second conveyor means so that the filler and the wrapping material form a rod.

25. The machine of claim 24, further comprising means for monitoring the density of the filler and means for changing the position of said equalizing means with reference to said first conveyor means by way of said adjusting means when the monitored density deviates from a predetermined value.

* * * * *